US006988912B2

(12) United States Patent
Bourgeas et al.

(10) Patent No.: US 6,988,912 B2
(45) Date of Patent: Jan. 24, 2006

(54) COAXIAL CONNECTOR FOR A PRINTED CIRCUIT CARD

(75) Inventors: Fabien Bourgeas, Saint Nicolas de Macherin (FR); Claude Brocheton, Grenoble (FR)

(73) Assignee: Radiall, Rosny-sous-Bois Cedex (FR)

( * ) Notice: Subject to any disclaimer, the term of this patent is extended or adjusted under 35 U.S.C. 154(b) by 0 days.

(21) Appl. No.: 11/109,824

(22) Filed: Apr. 20, 2005

(65) Prior Publication Data

US 2005/0250383 A1 Nov. 10, 2005

(30) Foreign Application Priority Data

May 10, 2004 (FR) ..... 04 05040

(51) Int. Cl.
*H01R 9/05* (2006.01)

(52) U.S. Cl. ..... 439/581
(58) Field of Classification Search ..... 439/581, 439/63; 333/33, 260
See application file for complete search history.

(56) References Cited

U.S. PATENT DOCUMENTS

| | | | | | |
|---|---|---|---|---|---|
| 4,867,704 | A * | 9/1989 | Standke | 439/581 |
| 4,995,815 | A * | 2/1991 | Buchanan et al. | 439/63 |
| 5,062,811 | A * | 11/1991 | Hackman | 439/620 |
| 5,823,791 | A * | 10/1998 | Bellantoni et al. | 439/63 |
| 5,835,071 | A | 11/1998 | Phelps | |
| 5,886,590 | A * | 3/1999 | Quan et al. | 333/33 |
| 5,897,384 | A | 4/1999 | Hosler, Sr. | |
| 6,106,304 | A * | 8/2000 | Huang | 439/63 |
| 6,126,453 | A * | 10/2000 | Gomez et al. | 439/63 |
| 6,238,218 | B1 * | 5/2001 | Baffert | 439/63 |
| 6,457,979 | B1 * | 10/2002 | Dove et al. | 439/63 |
| 2002/0177332 | A1 * | 11/2002 | Hubbard et al. | 439/63 |

* cited by examiner

*Primary Examiner*—Ross Gushi
(74) *Attorney, Agent, or Firm*—Oliff & Berridge, PLC

(57) ABSTRACT

The present invention relates to a coaxial connector for a printed circuit card, the connector having a connector body suitable for being secured to a printed circuit card, wherein the connector body is in the form of a shell surrounding the outer contact of the coaxial connector over substantially half of its circumference, said body presenting a plane bottom surface suitable for pressing against a surface of the printed circuit card, and a convex top surface of profile having a section that is curvilinear or polygonal.

4 Claims, 2 Drawing Sheets

COAXIAL CONNECTOR FOR A PRINTED CIRCUIT CARD

This non provisional application claims the benefit of French Application No. 04 05040 filed on May 10, 2004.

The present invention relates to a coaxial connector for a printed circuit card, the connector comprising a connector body suitable for being secured to a printed circuit card, in particular by soldering.

BACKGROUND OF THE INVENTION

The coaxial connector of the invention is usable in particular for making a front face connection with radio frequency (RF) modules located in an equipment bay of a base station.

In this application, the RF modules can be transmitter modules or receiver modules, for example, each comprising a printed circuit card having passive and active RF components mounted thereon interconnected by RF transmission lines formed on the printed circuit.

The RF modules are connected to one another by coaxial cords, and for this purpose each module has one or more coaxial connectors secured in the vicinity of an edge of the printed circuit card.

In order to avoid disturbing the external environment with parasitic electromagnetic emissions, each module is generally provided with its own electromagnetic shielding, firstly in order to prevent parasitic electromagnetic emissions associated with the radiation generated by the RF components within the module, and secondly to enable the module to operate properly without itself being disturbed by parasitic electromagnetic emissions coming from the outside.

Ensuring that the module is electromagnetically shielded requires the connectors on the front face to perform an electrical continuity function between the ground of the connector and the frame of the module.

Traditionally, this function has been implemented by a screw-and-nut system in the connector.

However, it is difficult to ensure electrical continuity between the frame and the various elements that pass through it, and at present the trend is towards limiting electromagnetic shielding to those sources of radiation that are situated on the printed circuit, i.e. the transmission lines and the passive and active RF components.

The shielding function is then provided by caps covering the various sources of radiation other than the coaxial connectors, since these are difficult to integrate.

As a result, the RF transmission lines interconnecting the circuit components to the connector need to be optimized in order to minimize radiation.

That requires the use of single-layer printed circuits and the use of plated-through holes in order to ground the RF lines (microstrips or strip lines). That has the drawback of generating additional RF losses.

OBJECTS AND SUMMARY OF THE INVENTION

An object of the present invention is to provide a coaxial connector for a printed circuit card that enables the above-mentioned drawbacks to be avoided, in particular when used in an RF module having a shielding cap, thus enabling the shielding of the module to be improved in terms of quality and ease of provision.

In the connector of the present invention, the connector body is in the form of a shell surrounding the outer contact of the coaxial connector over substantially half of its circumference, said body presenting a plane bottom surface suitable for pressing against a surface of the printed circuit card, and a convex top surface of profile having a section that is curvilinear or polygonal, in particular trapezoidal or triangular.

Advantageously, the angle formed between the plane surface of the connector body and a plane tangential to its top surface when it is of profile having a curvilinear section, or between the plane surface of the body of the connector and the face which connects to the top surface when it is of profile of polygonal section, is less than or equal to 70°.

According to the invention, the coaxial connector is preferably placed in a cutout formed starting from an end face of the printed circuit, the height of the connector body in the form of a shell being determined in such a manner that when its plane bottom surface is pressed against the printed circuit card, the central contact of the coaxial connector which extends parallel to the surface of the printed circuit is substantially tangential to said circuit.

Preferably, the coaxial connector of the invention includes a cap providing shielding relative to electromagnetic radiation, the cap having a front face with a bottom end suitable for coming into contact with the surface of the printed circuit card, said front face being provided with a cutout of profile corresponding to the profile of the top surface of the connector body, said cap, when put into place on the printed circuit card, covering the connector body, with a gasket providing sealing against electromagnetic radiation preferably being interposed therebetween.

BRIEF DESCRIPTION OF THE DRAWINGS

In order to make the present invention better understood, there follows a description of non-limiting embodiments given with reference to the accompanying drawings, in which.

MORE DETAILED DESCRIPTION

Figure 1:
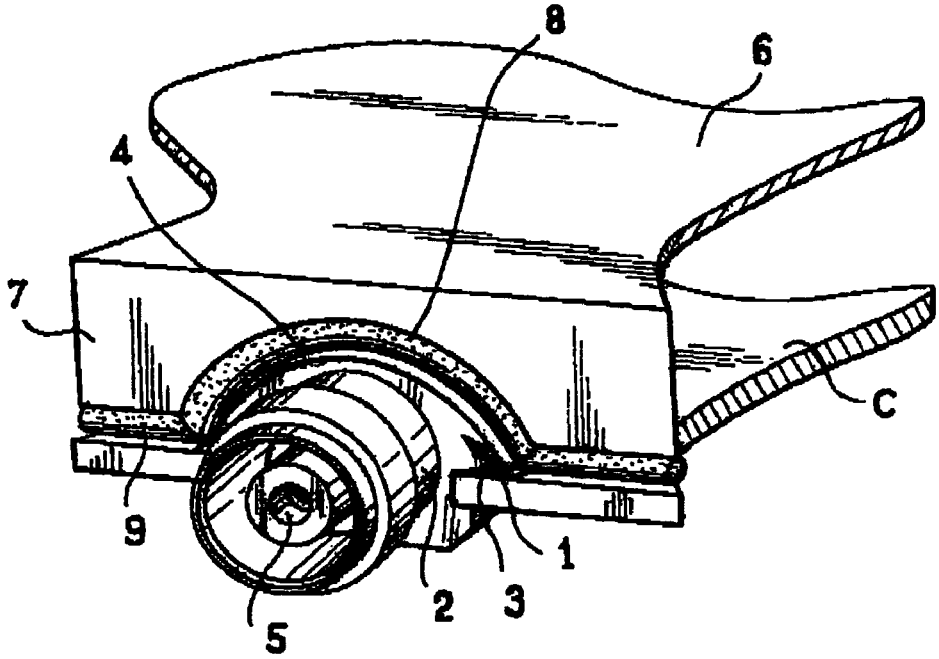
FIG. 1 is a cutaway diagrammatic perspective view of a coaxial connector of the invention mounted on a printed circuit card and provided with a shielding cap.
Figure 2:
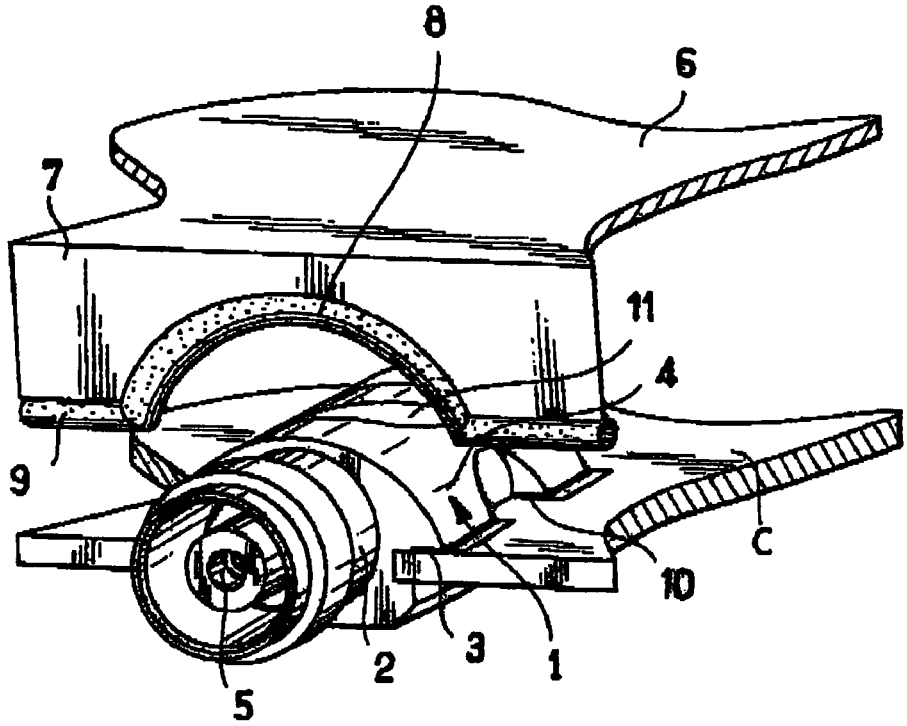
FIG. 2 is a view analogous to FIG. 1 prior to putting the shielding cap into place.
Figure 3:
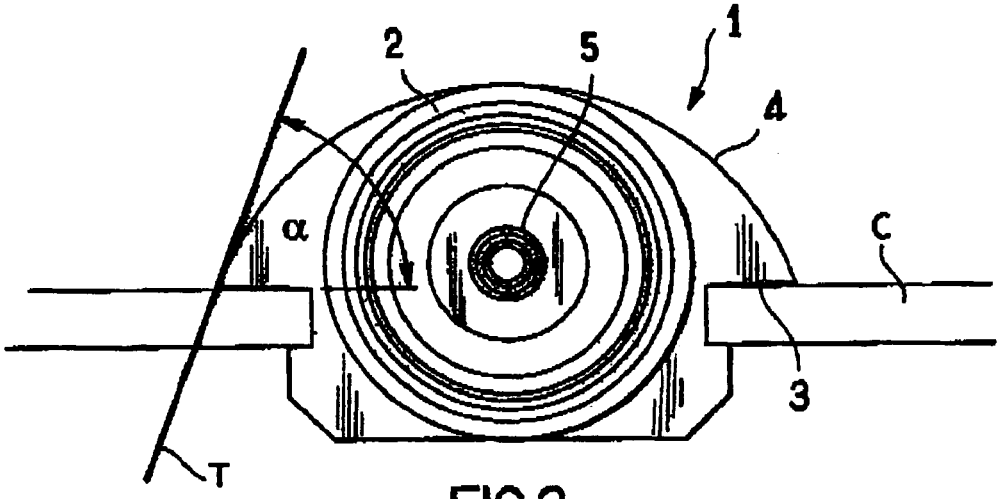
FIG. 3 is a diagrammatic end view of the coaxial connector shown in FIGS. 1 and 2.

The coaxial connector shown in FIGS. 1 to 3 presents a body 1 in the form of a shell surrounding the outer contact 2 of the coaxial connector over substantially half of its circumference. The shell body 1 presents a plane bottom surface 3 and a convex top surface of profile having a curvilinear section 4.

As can be seen in FIG. 3, an angle $\alpha$ is formed between the plane surface 3 of the connector body and a plane T tangential to its top surface 4, said angle being 70° in the example shown.

The coaxial connector is mounted on a printed circuit card C and is secured to the card by soldering the connector body 1 thereto.

As shown in FIGS. 1 and 2, the connector is put into place in a cutout formed in the printed circuit C starting from an end face thereof in such a manner that the outer contact bushing 2 projects forwards from the card C.

The plane surface 3 of the connector body 1 presses against the top surface of the printed circuit card C.

As can be seen in FIG. 3, in the mounted position, the central contact 5 of the coaxial connector which extends parallel to the surface of the printed circuit card C is substantially tangential to said surface, the center of the circle inscribed within the curvilinear profile of the top surface 4 of the body of the connector lying above the top surface of the printed circuit C.

In order to provide an electromagnetic shielding function, a cap 6 is put into place on the connector, the cap having a front face 7 provided with a cutout 8 of concave profile corresponding to the convex profile of the top surface 4 of the shell connector body. As can be seen in FIG. 1, when the cap is in place on the printed circuit, it covers the body of the connector and, in the example shown, a gasket 9 providing sealing against electromagnetic radiation is interposed therebetween. The gasket 9 is constituted, for example, of suitably-filled silicone and can be put into place easily using an applicator gun.

Thus, the connector is clamped between the cap and the integrated circuit, thereby improving the ability of the connector assembled on the card to withstand mechanical forces.

The matching shapes for the profile of the connector body and the front face cut out in the cap serve to ensure that substantially constant pressure is applied to the gasket for providing sealing against electromagnetic radiation, thereby guaranteeing shielding of good quality.

In addition, since the shielding cap is situated above the connector, it is possible to use a surface of the printed circuit that was not used in the past, thereby improving density and reducing costs. As a result, the transmission lines of the printed circuit can radiate and it is no longer necessary to use multilayer circuits, thereby simplifying design and further reducing costs.

It should also be mentioned that the profile of the body of the connector of the invention makes it possible to use central contacts that are straight without requiring bent contacts to be used, thus making assembly easier, the connector body having orifices 10 (visible in FIG. 2) for passing conductors for connection to the circuit of the card.

The connector body 1 has a handling zone 11 shown in FIG. 2.

Figure 4:
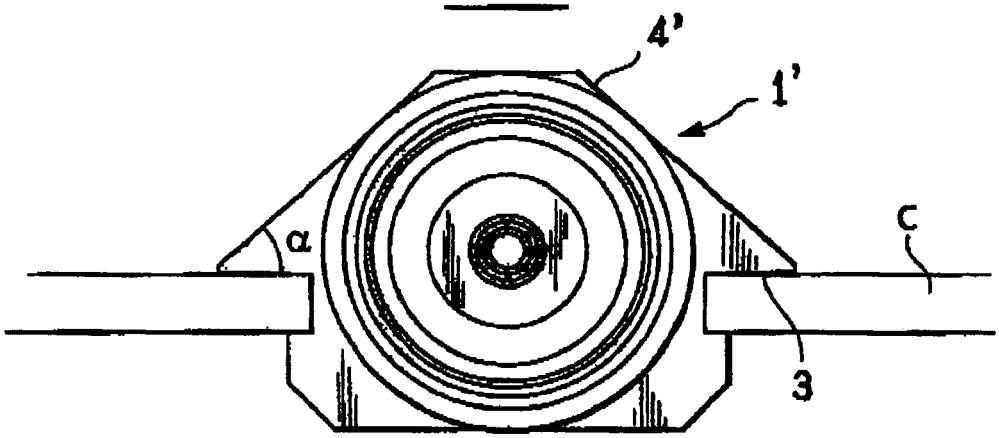
FIGS. 4 and 5 are views analogous to FIG. 2 showing variant embodiments.
Figure 5:
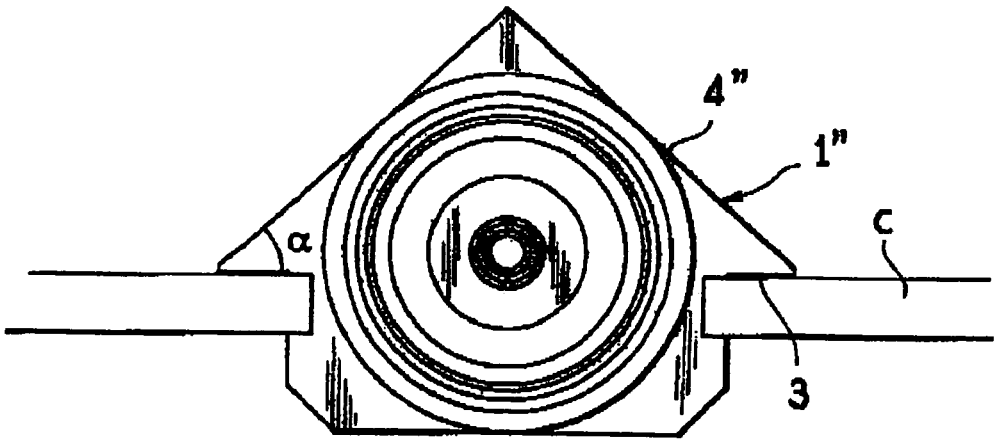

In the embodiment shown in FIG. 4, the connector body 1' has a top surface 4' with a profile that is trapezoidal in section, and in the embodiment of FIG. 5, the connector body 1" presents a top surface 4" with a profile that is triangular in section.

Between the plane surface of the body of the connector and the face of the top surface 4' or 4" connected thereto the angle $\alpha$ that is formed is the same as the angle $\alpha$ shown in FIG. 3.

Although the invention is described above with reference to particular embodiments, it will be understood that the invention is not limited in any way thereto and that variations and modifications can be applied thereto without thereby going beyond the ambit or the spirit of the invention.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A coaxial connector for a printed circuit card, the connector having a connector body suitable for being secured to a printed circuit card, wherein the connector body comprises a shell surrounding the outer contact of the coaxial connector over substantially half of a circumference thereof, said body including a planar bottom surface suitable for pressing against a surface of the printed circuit card, and a convex top surface of profile with a section that is one of curvilinear and polygonal, said connector further comprising a cap providing shielding against electromagnetic radiation, the cap having a front face with a bottom end suitable for coming into contact with the surface of the printed circuit card, said front face being provided with a cutout of profile corresponding to the profile of the top surface of the connector body, said cap, when put into place on the printed circuit card, covering the connector body.

2. A coaxial connector according to claim 1, wherein an angle $\alpha$, formed between one of the planar bottom surface of the connector body and a plane tangential to the convex top surface when of profile with the curvilinear section, and the planar bottom surface of the connector body and a face that connects to the convex top surface when of profile with the polygonal section, is less than or equal to 70°.

3. A coaxial connector according to claim 1, wherein a height of the connector body is determined in such a manner that when the planar bottom surface is pressed against the printed circuit card, a central contact of the coaxial connector extending parallel to the surface of the printed circuit card is substantially tangential to the planar bottom surface.

4. A coaxial connector according to claim 1, further comprising a gasket providing sealing against electromagnetic radiation interposed between the cap and the connector body and the printed circuit card.

* * * * *